US008506290B2

(12) United States Patent
Deng

(10) Patent No.: US 8,506,290 B2
(45) Date of Patent: Aug. 13, 2013

(54) HEATING APPARATUS WITH AIR SHUTTER ADJUSTMENT

(76) Inventor: David Deng, Diamond Bar, CA (US)

( * ) Notice: Subject to any disclaimer, the term of this patent is extended or adjusted under 35 U.S.C. 154(b) by 487 days.

(21) Appl. No.: 12/797,446

(22) Filed: Jun. 9, 2010

(65) Prior Publication Data

US 2010/0326422 A1 Dec. 30, 2010

Related U.S. Application Data

(60) Provisional application No. 61/221,470, filed on Jun. 29, 2009, provisional application No. 61/286,346, filed on Dec. 14, 2009.

(51) Int. Cl.

| | |
|---|---|
| ***F23D 14/62*** | (2006.01) |
| ***F24B 1/18*** | (2006.01) |
| ***F24H 1/00*** | (2006.01) |
| ***F16K 51/00*** | (2006.01) |

(52) U.S. Cl.

USPC ..... 431/354; 126/512; 432/222; 251/142

(58) Field of Classification Search

USPC ..... 431/354; 126/512; 432/222; 251/142

See application file for complete search history.

(56) References Cited

U.S. PATENT DOCUMENTS

| | | | |
|---|---|---|---|
| 743,714 | A | 11/1903 | Guese |
| 1,216,529 | A | 2/1917 | Wilcox |
| 1,589,386 | A | 6/1926 | Harper |
| 1,639,780 | A | 8/1927 | Mulholland |
| 1,860,942 | A | 5/1932 | Morse |
| 1,961,086 | A | 5/1934 | Sherman et al. |
| 2,054,588 | A | 9/1936 | Stephens |
| 2,095,064 | A | 10/1937 | Harper |
| 2,108,299 | A | 2/1938 | Steffen |
| 2,120,864 | A | 6/1938 | Kagi |
| 2,161,523 | A | 6/1939 | Moecker, Jr. et al. |
| 2,319,676 | A | 5/1943 | Guelson |
| 2,380,956 | A | 8/1945 | Evarts |
| 2,443,892 | A | 6/1948 | Caparone |
| 2,556,337 | A | 6/1951 | Paille |
| 2,630,821 | A | 3/1953 | Arey et al. |
| 3,139,879 | A | 7/1964 | Bauer et al. |
| 3,331,392 | A | 7/1967 | Davidson et al. |
| 3,590,806 | A | 7/1971 | Locke |
| 3,814,573 | A | 6/1974 | Karlovetz |

(Continued)

FOREIGN PATENT DOCUMENTS

| | | |
|---|---|---|
| CN | 1873268 | 12/2006 |
| DE | 720 854 C | 5/1942 |

(Continued)

OTHER PUBLICATIONS

Heat and Glo, Escape-42DV Owner's Manual, Rev. i, Dec. 2006.

(Continued)

*Primary Examiner* — Kenneth Rinehart
*Assistant Examiner* — William Corboy
(74) *Attorney, Agent, or Firm* — Knobbe Martens Olson & Bear LLP

(57) ABSTRACT

A heating apparatus can have a sealed combustion chamber. A burner and an air shutter can be within the sealed combustion chamber. An air shutter control can be outside of the sealed combustion chamber. The air shutter control can provide fine tuning adjustment of the air shutter.

16 Claims, 9 Drawing Sheets

(56) References Cited

U.S. PATENT DOCUMENTS

| | | | |
|---|---|---|---|
| 3,884,413 | A | 5/1975 | Berquist |
| D243,694 | S | 3/1977 | Faulkner |
| 4,021,190 | A | 5/1977 | Dickson |
| 4,290,450 | A | 9/1981 | Swanson |
| 4,348,172 | A | 9/1982 | Miller |
| 4,355,659 | A | 10/1982 | Kelchner |
| 4,718,846 | A | 1/1988 | Oguri et al. |
| 4,768,543 | A | 9/1988 | Wienke et al. |
| 4,768,947 | A | 9/1988 | Adachi |
| 4,782,814 | A | 11/1988 | Cherryholmes |
| 4,930,538 | A | 6/1990 | Browne |
| 4,965,707 | A | 10/1990 | Butterfield |
| 5,027,854 | A | 7/1991 | Genbauffe |
| 5,090,899 | A | 2/1992 | Kee |
| 5,172,728 | A | 12/1992 | Tsukazaki |
| 5,239,979 | A | 8/1993 | Maurice et al. |
| 5,379,794 | A | 1/1995 | Brown |
| 5,413,141 | A | 5/1995 | Dietiker |
| 5,452,709 | A | 9/1995 | Mealer |
| 5,470,018 | A | 11/1995 | Smith |
| 5,542,609 | A | 8/1996 | Myers et al. |
| 5,584,680 | A | 12/1996 | Kim |
| 5,642,580 | A | 7/1997 | Hess et al. |
| 5,645,043 | A | 7/1997 | Long et al. |
| D391,345 | S | 2/1998 | Mandir et al. |
| 5,807,098 | A | 9/1998 | Deng |
| 5,838,243 | A | 11/1998 | Gallo |
| 5,915,952 | A | 6/1999 | Manning et al. |
| 5,931,661 | A | 8/1999 | Kingery |
| 5,941,699 | A | 8/1999 | Abele |
| 5,975,112 | A | 11/1999 | Ohmi et al. |
| 5,988,204 | A | 11/1999 | Reinhardt et al. |
| 6,035,893 | A | 3/2000 | Ohmi et al. |
| 6,076,517 | A | 6/2000 | Kahlke et al. |
| 6,257,270 | B1 | 7/2001 | Ohmi et al. |
| 6,340,298 | B1 | 1/2002 | Vandrak et al. |
| 6,845,966 | B1 | 1/2005 | Albizuri |
| 6,904,873 | B1 | 6/2005 | Ashton |
| 6,910,496 | B2 | 6/2005 | Strom |
| 7,013,886 | B2 | 3/2006 | Deng |
| 7,048,538 | B2 | 5/2006 | Albizuri |
| 7,156,370 | B2 | 1/2007 | Albizuri |
| 7,174,913 | B2 | 2/2007 | Albizuri |
| 7,458,386 | B2 | 12/2008 | Zhang |
| 7,591,257 | B2 | 9/2009 | Bayer et al. |
| 7,607,426 | B2 | 10/2009 | Deng |
| 7,677,236 | B2 | 3/2010 | Deng |
| 7,766,006 | B1 | 8/2010 | Manning |
| 7,967,006 | B2 | 6/2011 | Deng |
| 7,967,007 | B2 | 6/2011 | Deng |
| 8,011,920 | B2 | 9/2011 | Deng |
| 8,152,515 | B2 | 4/2012 | Deng |
| 2004/0238030 | A1 | 12/2004 | Dewey, Jr. |
| 2005/0202361 | A1 | 9/2005 | Albizuri |
| 2006/0154194 | A1* | 7/2006 | Panther et al. ..... 431/354 |
| 2006/0201496 | A1 | 9/2006 | Shingler |
| 2008/0149871 | A1 | 6/2008 | Deng |
| 2008/0153044 | A1 | 6/2008 | Deng |
| 2008/0223465 | A1 | 9/2008 | Deng |
| 2008/0227045 | A1 | 9/2008 | Deng |
| 2008/0236688 | A1 | 10/2008 | Albizuri |
| 2008/0236689 | A1 | 10/2008 | Albizuri |
| 2009/0140193 | A1 | 6/2009 | Albizuri Landa |
| 2009/0159068 | A1 | 6/2009 | Querejeta et al. |
| 2009/0280448 | A1 | 11/2009 | Antxia Uribetxebarria et al. |
| 2010/0089385 | A1 | 4/2010 | Albizuri |
| 2010/0089386 | A1 | 4/2010 | Albizuri |
| 2010/0154777 | A1 | 6/2010 | Carvalho et al. |
| 2010/0326430 | A1 | 12/2010 | Deng |
| 2010/0330518 | A1 | 12/2010 | Deng |
| 2012/0080024 | A1 | 4/2012 | Deng |
| 2012/0132189 | A1 | 5/2012 | Deng |

FOREIGN PATENT DOCUMENTS

| | | | |
|---|---|---|---|
| JP | 58 219320 | A | 12/1983 |
| JP | 62169926 | | 7/1987 |
| JP | 03 230015 | A | 10/1991 |
| JP | 2000234738 | | 8/2000 |
| JP | 2003 056845 | A | 2/2003 |
| JP | 2003-65533 | | 3/2003 |
| JP | 2003 074837 | A | 3/2003 |
| JP | 2003 074838 | A | 3/2003 |
| JP | 2003-83537 | | 3/2003 |
| JP | 2003-90517 | | 3/2003 |
| WO | WO 2008/071970 | | 6/2008 |

OTHER PUBLICATIONS

Heat and Glo, Escape Series Gas Fireplaces, Mar. 2005.

Napoleon, Park Avenue Installation and Operation Instructions, Jul. 20, 2006.

Napoleon, The Madison Installation and Operation Instructions, May 24, 2005.

* cited by examiner

HEATING APPARATUS WITH AIR SHUTTER ADJUSTMENT

CROSS-REFERENCE TO RELATED APPLICATIONS

This application claims the benefit under 35 U.S.C. §119 (e) of U.S. Provisional Application Nos. 61/221,470, filed Jun. 29, 2009, titled HEATING APPARATUS WITH AIR SHUTTER ADJUSTMENT, and 61/286,346, filed Dec. 14, 2009, of the same title, the entire contents of all of which are hereby incorporated by reference herein and made a part of this specification.

BACKGROUND OF THE INVENTION

1. Field of the Invention

Certain embodiments disclosed herein relate generally to heating devices, and relate more specifically to fluid-fueled heating devices, such as, for example, gas fireplaces.

2. Description of the Related Art

Many varieties of heaters, fireplaces, stoves, and other heating devices utilize pressurized, combustible fuels. Some such devices operate with liquid propane gas, while others operate with natural gas. However, such devices and certain components thereof have various limitations and disadvantages.

SUMMARY OF THE INVENTION

According to certain embodiments, a heating apparatus can comprise a sealed combustion chamber, a burner within the sealed combustion chamber, a fuel channel for directing a fuel from a fuel source external the sealed combustion chamber to the burner, a fitting, through which the fuel channel passes into the sealed combustion chamber and a burner nozzle communicating with the fuel channel. The heating apparatus can further comprise an air shutter within the sealed combustion chamber and configured to alter the amount of air being mixed with the fuel in the fuel channel and an air shutter control configured to permit the amount of air to be mixed with the fuel through the air shutter to be adjusted, wherein the air shutter control is coupled to the air shutter through the fitting.

In some embodiments, the air shutter control can be configured to control fine adjustment of the air shutter to adjust the precise amount of air for a particular fuel. In some embodiments, the air shutter can comprise a cylinder having a window and surrounding the fuel line, the fuel line having an opening and the air shutter configured to allow or block an amount of air through the opening. In some embodiments, the air shutter control can comprise a valve configured to rotate within the fuel line and to thereby change the position of the air shutter.

Certain embodiments of an air shutter control can comprise a user interface surface. The user interface surface can comprise an adjustment dial.

In some embodiments, the valve controls a position of the burner nozzle. The valve only haves an open fuel flow position in some embodiments. The valve can be configured to rotate the burner nozzle.

A heating apparatus according to some embodiments can comprise a sealed combustion chamber, a burner for combusting a fuel within the sealed combustion chamber, an air inlet for directing outside air into the sealed combustion chamber, an exhaust for exhausting waste gas out of the sealed combustion chamber and an air shutter for allowing air to mix with the fuel to be combusted, the air shutter being within the sealed combustion chamber. The heating apparatus can further comprise an air shutter control to permit the position of the air shutter to be adjusted and thereby the amount of air to mix with the fuel, a fuel line partially within the sealed combustion chamber and partially outside of the seal combustion chamber, configured to direct the fuel to the burner and having an air/fuel mixing chamber and a burner nozzle communicating with the fuel line and located upstream of the mixing chamber, the burner nozzle configured to inject fuel into the mixing chamber to mix the fuel with air. The air shutter control can be configured to control the air shutter through the fuel line.

In some embodiments, the air shutter control can comprise a valve, the valve being part of the fuel line. In some embodiments, the valve can control a position of the nozzle. In some embodiments, the valve can rotate to rotate the position of the air shutter. In some embodiments, the valve rotates within a fitting such that the fuel line and the air shutter control pass into the sealed combustion chamber together. In some embodiments, the nozzle and the actuator are coaxial.

Certain embodiments of heating apparatus comprise a direct vent or builder vent heater.

BRIEF DESCRIPTION OF THE DRAWINGS

Various embodiments are depicted in the accompanying drawings for illustrative purposes, and should in no way be interpreted as limiting the scope of the inventions.

DETAILED DESCRIPTION OF THE PREFERRED EMBODIMENT

Figure 1:
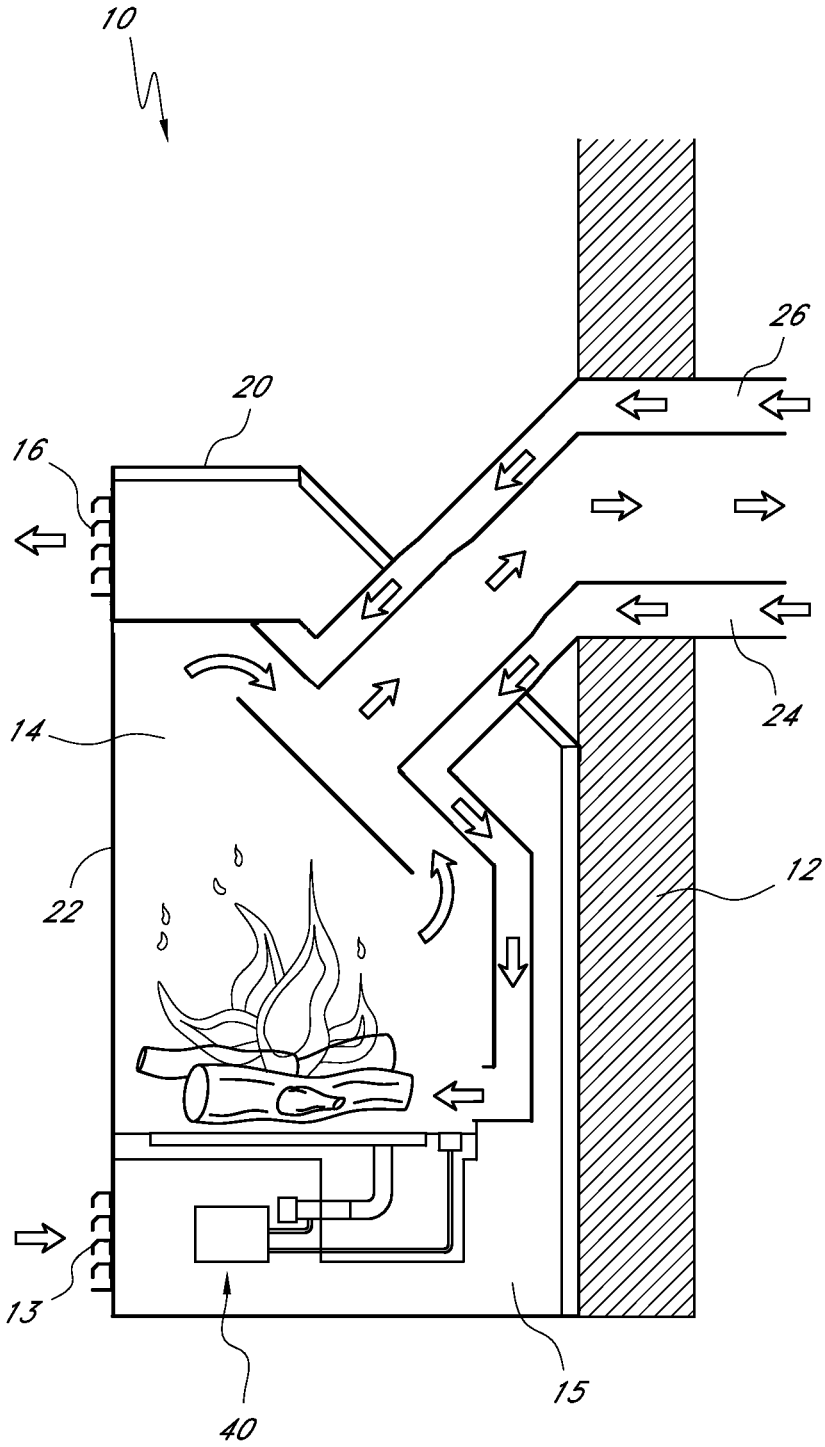
FIG. 1 is a schematic view of a heating device.

Many varieties of space heaters, wall heaters, stoves, fireplaces, fireplace inserts, gas logs, and other heat-producing devices employ combustible fluid fuels, such as liquid propane and natural gas. The term "fluid," as used herein, is a broad term used in its ordinary sense, and includes materials or substances capable of fluid flow, such as, for example, one or more gases, one or more liquids, or any combination thereof. Fluid-fueled units, such as those listed above, generally are designed to operate with a single fluid fuel type at a specific pressure or within a range of pressures. For example, some fluid-fueled heaters that are configured to be installed on a wall or a floor operate with natural gas at a pressure in a range from about 3 inches of water column to about 6 inches of water column, while others are configured to operate with liquid propane at a pressure in a range from about 8 inches of water column to about 12 inches of water column. Similarly, some gas fireplaces and gas logs are configured to operate with natural gas at a first pressure, while others are configured to operate with liquid propane at a second pressure that is different from the first pressure. As used herein, the terms "first" and "second" are used for convenience, and do not connote a hierarchical relationship among the items so identified, unless otherwise indicated.

Direct-vent fireplaces require a balanced flow of combustion air and exhaust gas moving through the intake and exhaust ducts to provide an aesthetically desirable flame in the firebox. Desirable flame characteristics can include, for example, appearing similar to a natural wood-fire flame. The size, color and action of the flames in the firebox can be adjusted by selectively balancing the flow of combustion air and exhaust gas. A balanced flow also allows direct-vent fireplaces to function in a thermally efficient manner. Accordingly, an important part of the fireplace insert's installation is to properly balance the combustion air intake flow and the exhaust gas flow.

In addition, in some instances, the appearance of a flame produced by certain embodiments of fluid-fueled units is important to the marketability of the units. For example, some gas fireplaces and gas fireplace inserts are desirable as either replacements for or additions to natural wood-burning fireplaces. Such replacement units can desirably exhibit enhanced efficiency, improved safety, and/or reduced mess. In many instances, a flame produced by such a gas unit desirably resembles that produced by burning wood, and thus preferably has a substantially yellow hue.

Certain embodiments of fluid-fueled units can produce substantially yellow flames. The amount of oxygen present in the fuel at a combustion site of a unit (e.g., at a burner) can affect the color of the flame produced by the unit. Accordingly, in some embodiments, one or more components of the unit are adjusted to regulate the amount of air that is mixed with the fuel to create a proper air/fuel mixture at the burner. Such adjustments can be influenced by the pressure at which the fuel is dispensed.

The conventional insert-style fireplace insert is typically installed and balanced by first sliding the insert into a close-fit fireplace cavity so a limited access space is provided between the fireplace insert and the cavity's walls. The installer reaches through the limited access space to connect the fireplace insert to the exhaust duct and the intake duct. The installer then balances the flow of combustion air and the exhaust gas while the fire is burning in the firebox in order to visually analyze the flame characteristics. Limited access to the adjustment mechanisms for the intake duct, the exhaust duct or an air shutter can make this balancing a time-consuming and labor intensive process requiring multiple adjustments of the adjustment mechanisms during installation.

Certain embodiments disclosed herein reduce or eliminate one or more of the foregoing problems associated with existing fluid-fueled devices and/or provide some or all of the desirable features detailed above. Although certain embodiments discussed herein are described in the context of directly vented heating units, such as fireplaces and fireplace inserts, it should be understood that certain features, principles, and/or advantages described are applicable in a much wider variety of contexts, including, for example, vent-free heating units, gas logs, heaters, heating stoves, cooking stoves, barbecue grills, water heaters, and any flame-producing and/or heat-producing fluid-fueled unit, including without limitation units that include a burner of any suitable variety.

Figure 2:
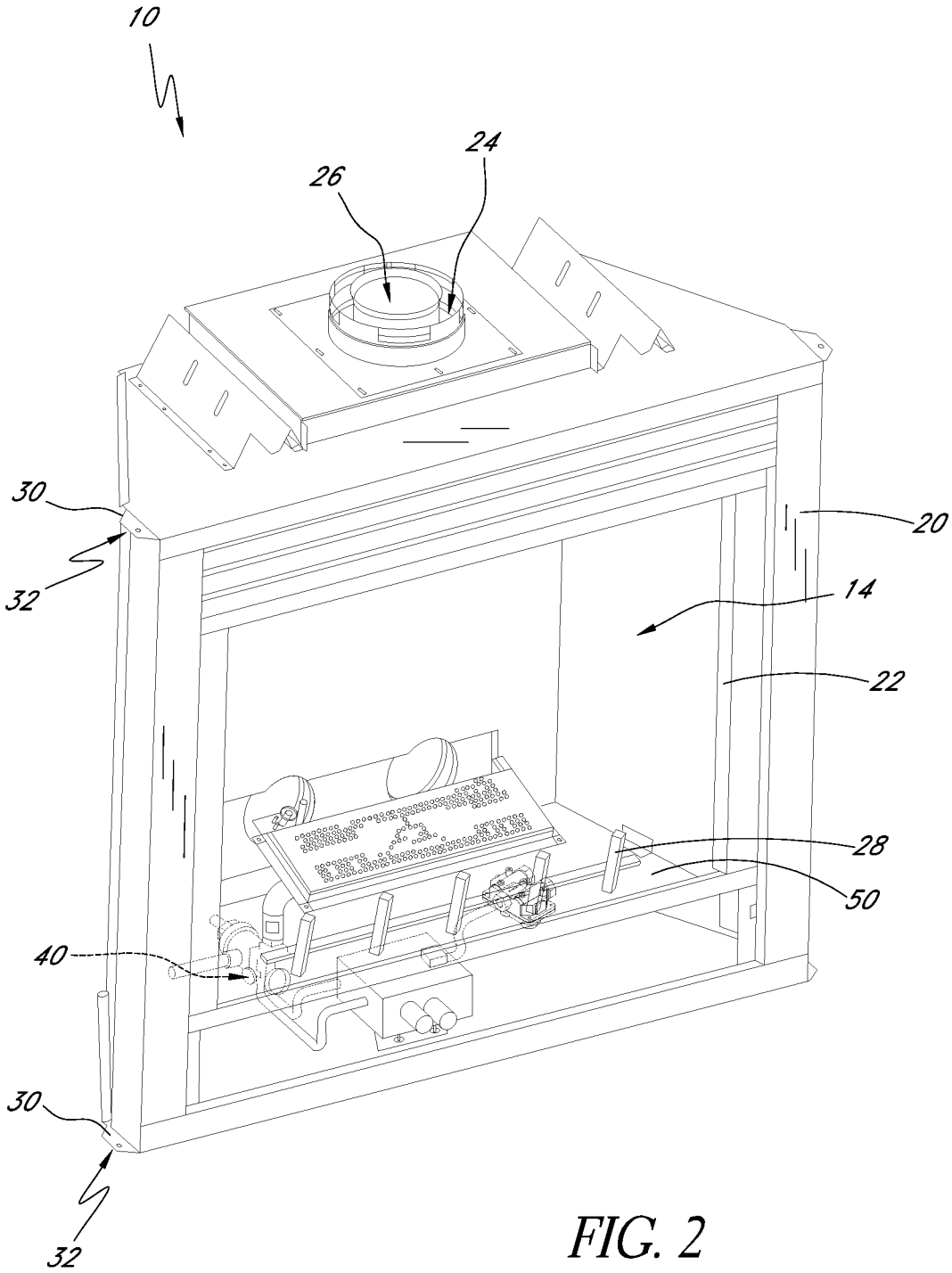
FIG. 2 is a perspective view of an embodiment of a heating device.

FIGS. 1 and 2 illustrate an embodiment of a fireplace, fireplace insert, heat-generating unit, or heating device 10 configured to operate with a source of combustible fuel. In various embodiments, the heating device 10 is configured to be installed within a suitable cavity, such as the firebox of a fireplace or a dedicated outer casing. The heating device 10 can extend through a wall 12, in some embodiments.

The heating device 10 includes a housing 20. The housing 20 can include metal or some other suitable material for providing structure to the heating device 10 without melting or otherwise deforming in a heated environment. The housing 20 can define a window 22. In some embodiments, the window 22 comprises a sheet of substantially clear material, such as tempered glass, that is substantially impervious to heated air but substantially transmissive to radiant energy.

The heating device 10 can include a sealed chamber 14. The sealed chamber 14 can be sealed to the outside with the exception of the air intake 24 and the exhaust 26. Heated air does not flow from the sealed chamber to the surroundings; instead air, for example from in an interior room, can enter an inlet vent 13 into the housing 20. The air can pass through the housing in channel 15 passing over the outside of the sealed chamber 14 and over the exhaust 26. Heat can be transferred to the air which can then pass into the interior room through outlet vent 16.

In some embodiments, the heating device 10 includes a grill, rack, or grate 28. The grate 28 can provide a surface against which artificial logs may rest, and can resemble similar structures used in wood-burning fireplaces. In certain embodiments, the housing 20 defines one or more mounting flanges 30 used to secure the heating device 10 to a floor and/or one or more walls. The mounting flanges 30 can include apertures 32 through which mounting hardware can be advanced. Accordingly, in some embodiments, the housing 20 can be installed in a relatively fixed fashion within a building or other structure.

As shown, the heating device 10 includes a fuel delivery system 40, which can have portions for accepting fuel from a fuel source, for directing flow of fuel within the heating device 10, and for combusting fuel. In the embodiment illustrated in FIG. 2, portions of an embodiment of the fuel delivery system 40 that would be obscured by the heating device 10 are shown in phantom. Specifically, the illustrated heating device 10 includes a floor 50 which forms the bottom of the sealed combustion chamber 14 and the components shown in phantom are positioned beneath the floor 50.

Figure 2A:
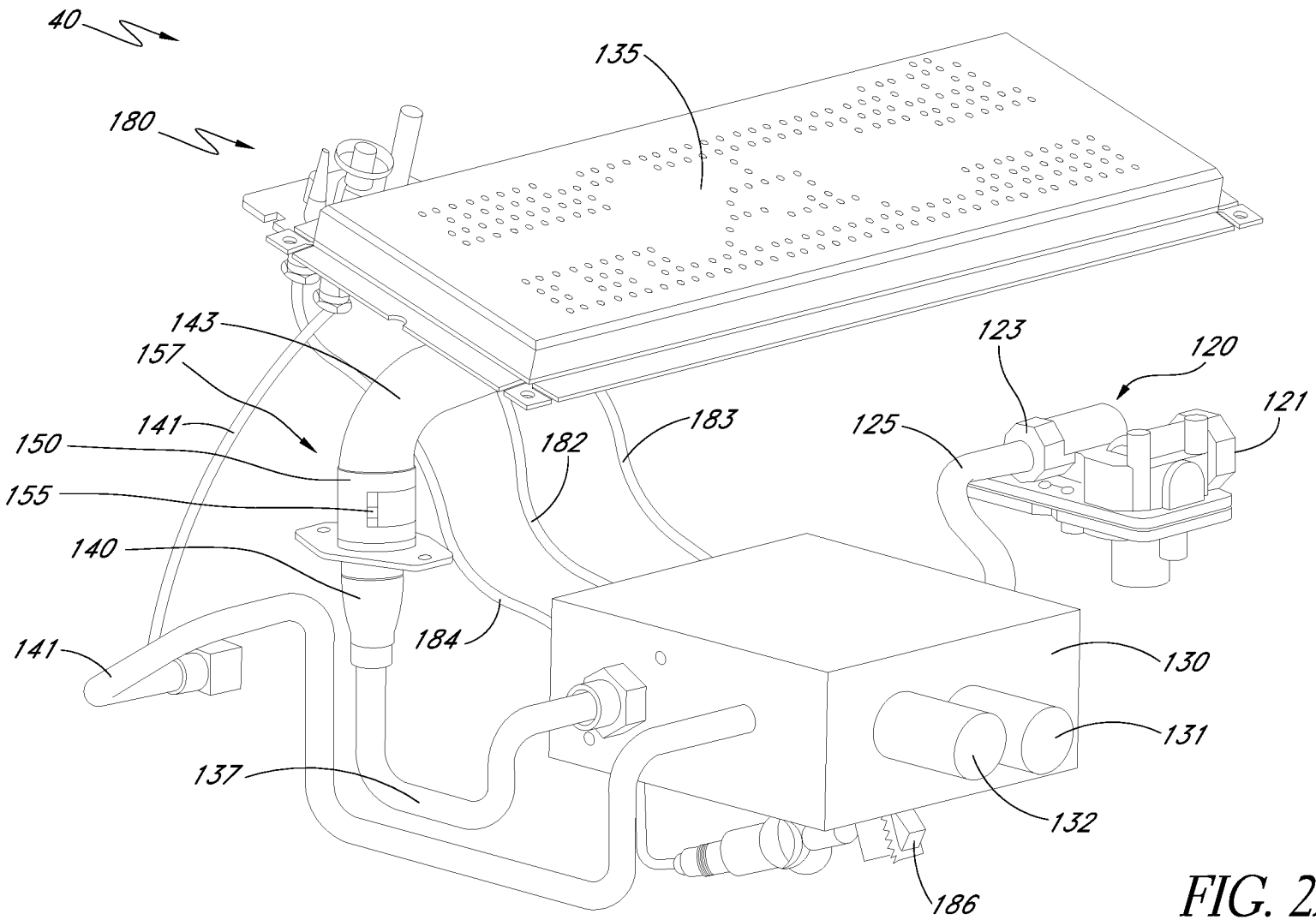
FIG. 2A is a perspective view of an embodiment of a fuel delivery system compatible with the heating device of FIG. 2.

With reference to FIG. 2A, an example of a fuel delivery system is shown. The fuel delivery system 40 can include a regulator 120. The regulator 120 can be configured to selectively receive a fluid fuel (e.g., propane or natural gas) from a source at a certain pressure. In certain embodiments, the regulator 120 includes an input port 121 for receiving the fuel. The regulator 120 can define an output port 123 through which fuel exits the regulator 120. Accordingly, in many embodiments, the regulator 120 is configured to operate in a state in which fuel is received via the input port 121 and delivered to the output port 123. In certain embodiments, the regulator 120 is configured to regulate fuel entering the port 121 such that fuel exiting the output port 123 is at a relatively steady pressure. The regulator 120 can function in ways similar to the pressure regulators disclosed in U.S. patent application Ser. No. 11/443,484, filed May 30, 2006, the entire contents of which are hereby incorporated by reference herein and made a part of this specification.

The output port 123 of the regulator 120 can be coupled with a source line or channel 125. The source line 125, and any other fluid line described herein, can comprise piping, tubing, conduit, or any other suitable structure adapted to direct or channel fuel along a flow path. In some embodiments, the source line 125 is coupled with the output port 123 at one end and is coupled with a control valve 130 at another end. The source line 125 can thus provide fluid communication between the regulator 120 and the control valve 130.

The control valve 130 can be configured to regulate the amount of fuel delivered to portions of the fuel delivery system 40. Various configurations of the control valve 130 are possible, including those known in the art as well as those yet to be devised. In some embodiments, the control valve 130 includes a millivolt valve. The control valve 130 can comprise a first knob or dial 131 and a second dial 132. In some embodiments, the first dial 131 can be rotated to adjust the amount of fuel delivered to a burner 135, and the second dial 132 can be rotated to adjust a setting of a thermostat. In other embodiments, the control valve 130 comprises a single dial 131.

In many embodiments, the control valve 130 is coupled with a burner transport line or channel 137 and a pilot transport or delivery line 141. The burner transport line 137 can be coupled with a nozzle assembly 140 which can be further coupled with a burner delivery line 143. The nozzle assembly 140 can be configured to direct fuel received from the burner transport line 132 to the burner delivery line or channel 143.

The pilot delivery line 141 is coupled with a safety pilot, pilot assembly, or pilot 180. Fuel delivered to the pilot 180 can be combusted to form a pilot flame, which can serve to ignite fuel delivered to the burner 135 and/or serve as a safety control feedback mechanism that can cause the control valve 130 to shut off delivery of fuel to the fuel delivery system 40. Additionally, in some embodiments, the pilot 180 is configured to provide power to the control valve 130. Accordingly, in some embodiments, the pilot 180 is coupled with the control valve 130 by one or more of a feedback line 182 and a power line 183.

The pilot 180 can comprise an igniter or an electrode configured to ignite fuel delivered to the pilot 180 via the pilot delivery line 141. Accordingly, the pilot 180 can be coupled with an igniter line 184, which can be connected to an igniter actuator, button, or switch 186. In some embodiments, the igniter switch 186 is mounted to the control valve 130. In other embodiments, the igniter switch 186 is mounted to the housing 20 of the heating device 10. The pilot 180 can also comprise a thermocouple. Any of the lines 182, 183, 184 can comprise any suitable medium for communicating an electrical quantity, such as a voltage or an electrical current. For example, in some embodiments, one or more of the lines 182, 183, 184 comprise a metal wire.

The burner delivery line 143 is situated to receive fuel from the nozzle assembly 140, and can be connected to the burner 135. The burner 135 can comprise any suitable burner, such as, for example, a ceramic tile burner or a blue flame burner, and is preferably configured to continuously combust fuel delivered via the burner delivery line 143.

The flow of fuel through the fuel delivery system 40, as shown, will now be described. A fuel is introduced into the fuel delivery system 40 through the regulator 120 which then proceeds from the regulator 120 through the source line or channel 125 to the control valve 130. The control valve 130 can permit a portion of the fuel to flow into the burner transport line or channel 132, and can permit another portion of the fuel to flow into the pilot transport line or channel 141. The fuel flow in the burner transport line 132 can proceed to the nozzle assembly 140. The nozzle assembly 140 can direct fuel from the burner transport line or channel 132 into the burner delivery line or channel 143. In some embodiments, fuel flows through the pilot delivery line or channel 141 to the pilot 180, where it is combusted. In some embodiments, fuel flows through the burner delivery line or channel 143 to the burner 135, where it is combusted.

An air shutter 150 can also be along the burner delivery line 143. The air shutter 150 can be used to introduce air into the flow of fuel prior to combustion at the burner 135. This can create a mixing chamber 157 where air and fuel is mixed together prior to passing through the burner delivery line 143 to the burner 135. The amount of air that is needed to be introduced can depend on the type of fuel used. For example, propane gas at typical pressures needs more air than natural gas to produce a flame of the same size.

The air shutter 150 can be adjusted by increasing or decreasing the size of a window 155. The window 155 can be configured to allow air to pass into and mix with fuel in the burner delivery line 143.

The air shutter 150, along with the burner 135 and the pilot 180 can be within the sealed combustion chamber 14. Because the combustion chamber 14 is sealed, it can be difficult to access components within the combustion chamber 14. For this reason some of the components are within the combustion chamber 14 but many are not. In some embodiments, only the components necessary for combustion are within the chamber 90 and all others are outside the chamber 14. For example, the other components can be in the channel 15 of the housing 20 (FIG. 1). It is necessary for connecting pipes, lines or channels and some parts of other components to pass into the sealed combustion chamber 14 and remain partially inside the sealed combustion chamber 14 and partially outside. Fittings can be used to allow the necessary components to pass into the chamber 14 while otherwise sealing the entry point into the sealed combustion chamber 14.

As the air shutter 150 is within the sealed combustion chamber 14, it can be difficult to adjust to the proper setting. In some currently available heaters, a long screw is used to adjust the air shutter. The long screw passes into the sealed combustion chamber through a fitting and the end attaches to the air shutter. Advancing or withdrawing the screw into or out of the sealed combustion chamber can move the air shutter to adjust the size of the window. A long screw can be cumbersome and does not provide any indication to the user as to the position of the air shutter.

Figure 3:
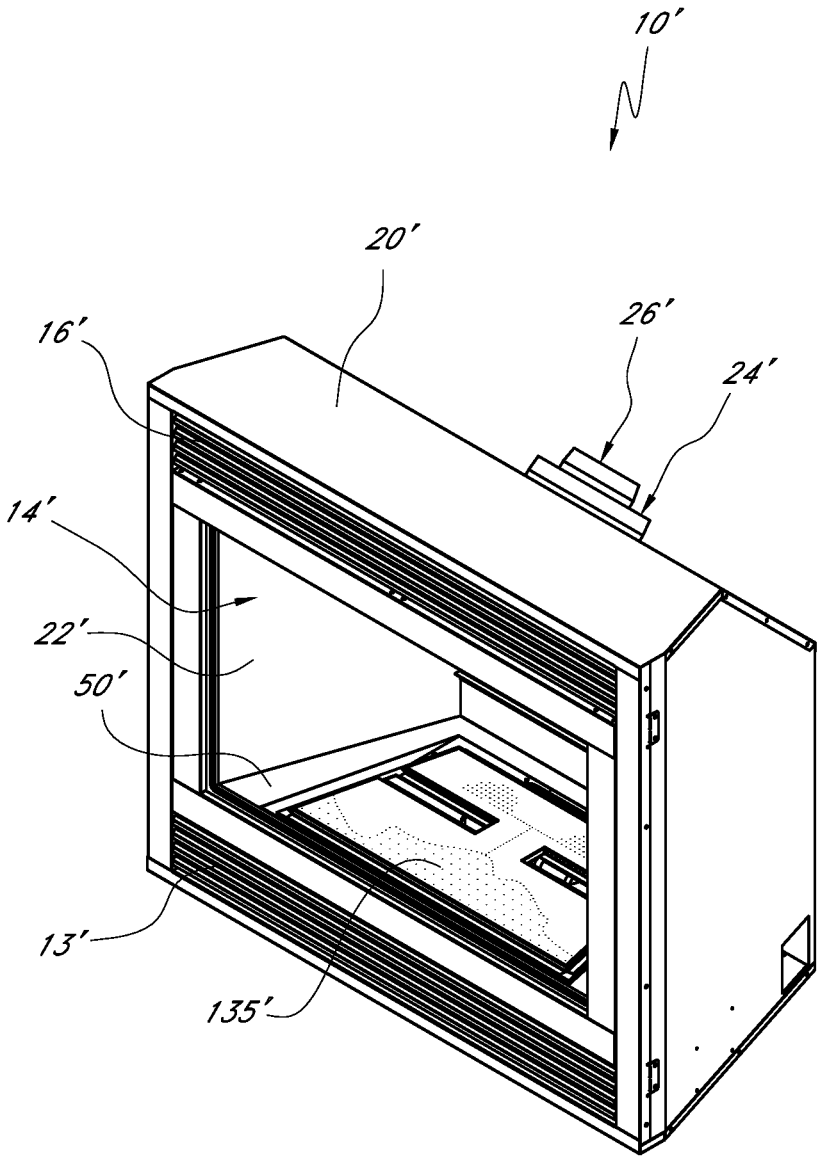
FIG. 3 is a perspective view of another embodiment of a heating device.
Figure 3A:
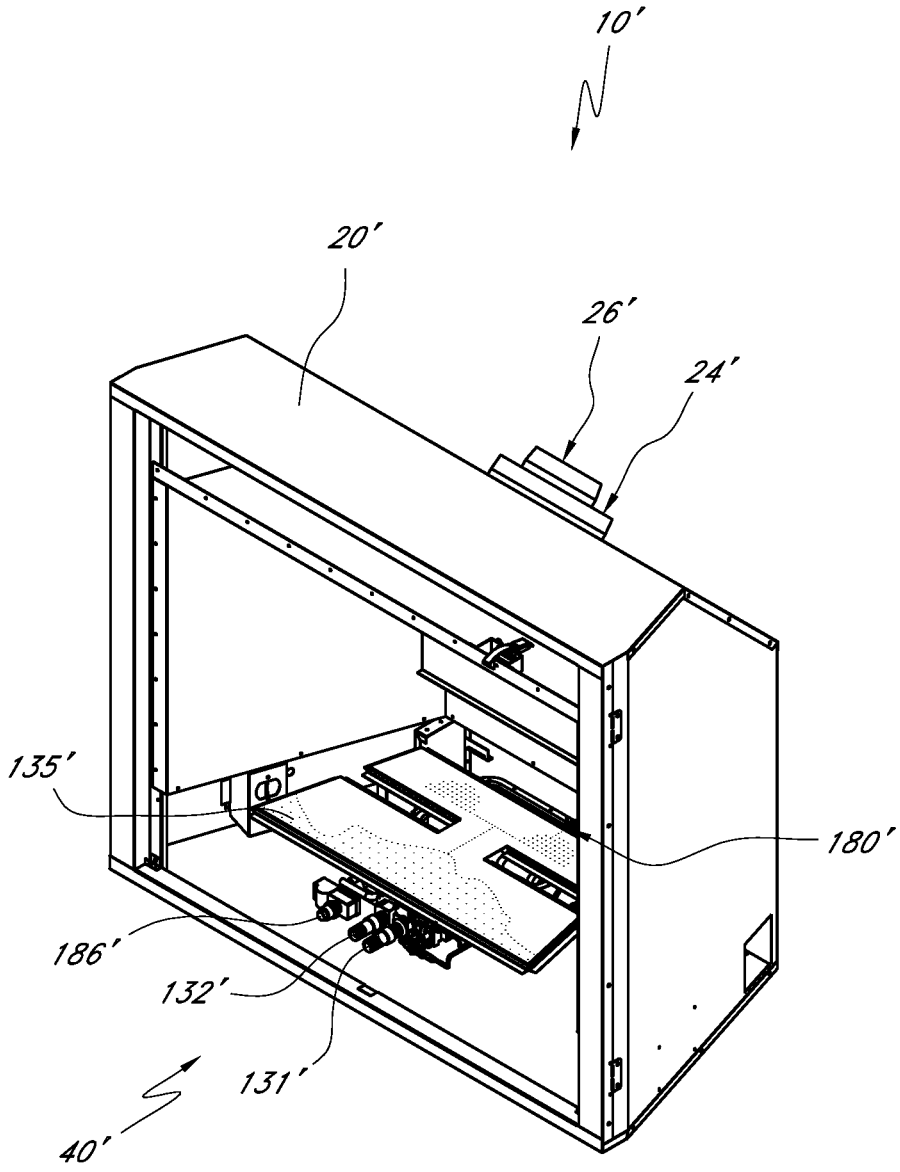
FIG. 3A is a partially disassembled perspective view of the heating device of FIG. 3.
Figure 3B:
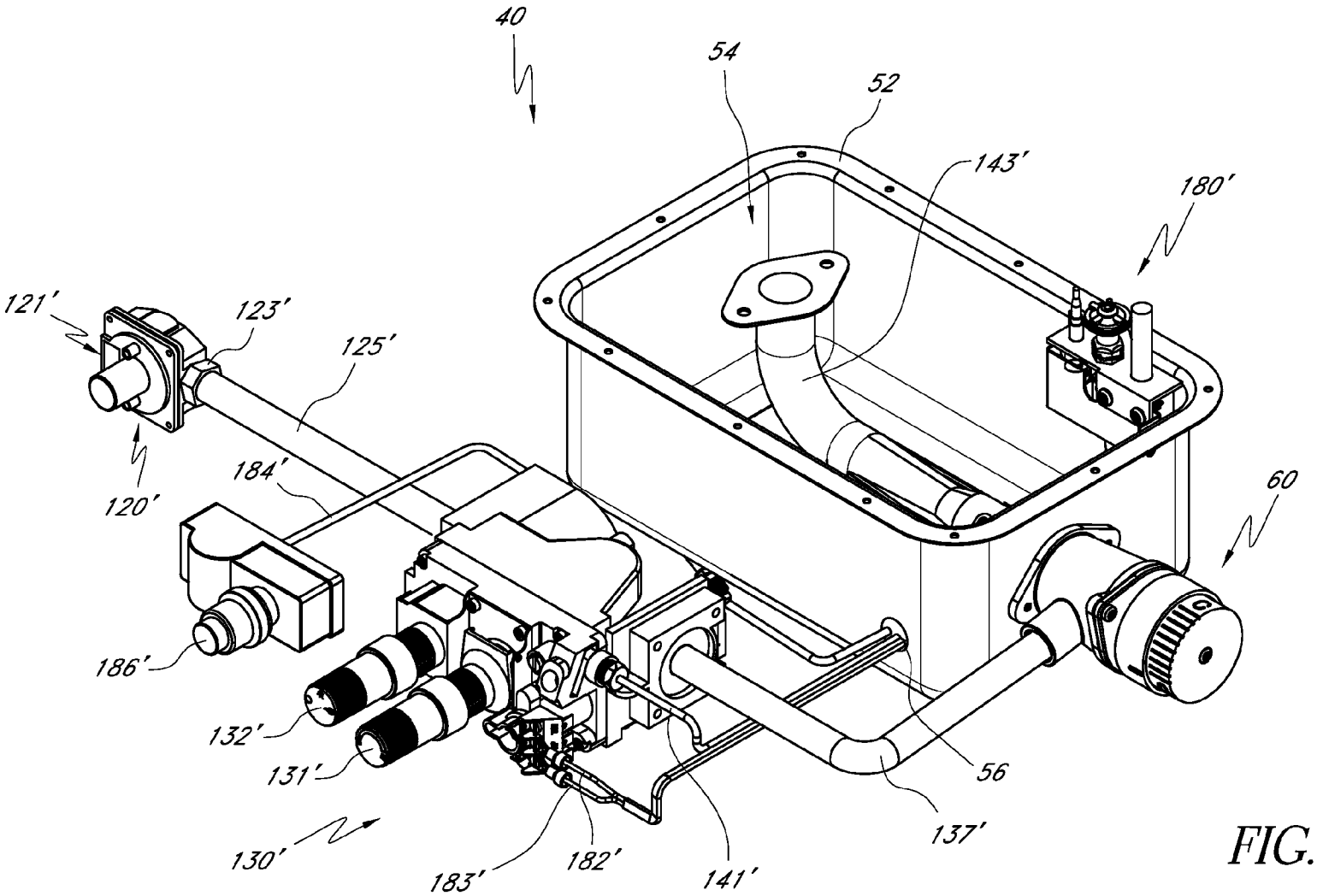
FIG. 3B is a perspective view of an embodiment of a fuel delivery system compatible with the heating device of FIG. 3.

FIGS. 3, 3A and 3B illustrate another embodiment of a heating device 10' and a fuel delivery system 40' compatible with the heating device 10'. Numerical reference to components is the same as previously described, except that a prime symbol (') has been added to the reference. Where such references occur, it is to be understood that the components are the same or substantially similar to previously-described components.

As can be seen in FIG. 3, a direct vent heating device 10' can have a housing 20' which encloses a sealed chamber 14' with a burner 135' inside the sealed chamber. FIG. 3A shows the heating device 10' in a partially disassembled view. For example, part of the outer housing 20', such as vents 13', 16' have been removed, as has the floor 50'. This view shows some of the components of the heating device 10', such as parts of the fuel delivery system 40'.

Turning now to FIG. 3B an embodiment of a fuel delivery system 40' is shown that can be compatible with many different heating devices including the heating device shown in FIG. 3. The fuel delivery system 40' can include many of the components previously described with respect to FIG. 2A, such as a pilot assembly 180', an igniter 186' and a control valve 130'.

Also shown in FIG. 3B is a basket 52. The inner portion 54 of the basket 52 can be part of the sealed chamber 14'. The basket 52 can be used to store certain parts of the heating device such as components of the fuel delivery system 40' within the sealed chamber 14'. The basket 52 can also attach to the floor 50' and can be configured to allow certain components, pipes, wires, etc. to pass through the basket 52. Gaskets 56 can be used to seal access points into the basket 52, floor 50' or other parts of the sealed chamber 14'.

FIGS. 4A-E illustrate one embodiment of an improved air shutter control 60. In some embodiments, the air shutter control 60 can replace the nozzle assembly 140 in FIG. 2A, similar to the configuration shown in FIG. 3B. The burner transport line 137' can connect to an inlet 62 on the air shutter control 60. Fuel can be directed from the inlet 62 through a valve 64 to an injector orifice or nozzle 66. The fuel can be injected into the mixing chamber 157' to mix with air introduced through the air shutter 150' to pass into the burner delivery line 143' to then be delivered to the burner 135' for combustion.

Figure 5:
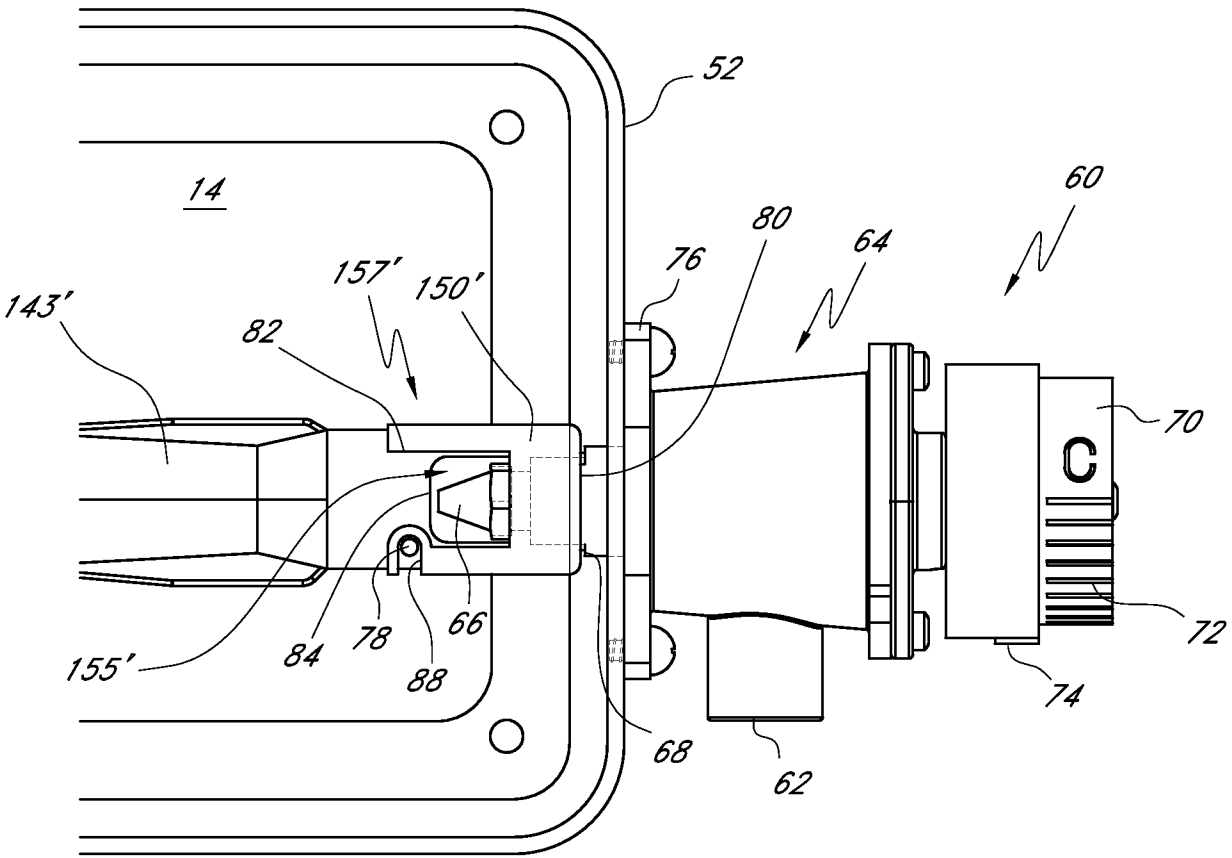
FIG. 5 shows the air shutter control of FIGS. 4A-D attached to an air shutter.

Looking now at FIG. 5, as shown an air shutter 150' can comprise a cylinder or other shape with a slot 80 sized to fit on ledge 68 of the valve 64. The air shutter 150' can be configured to move with the valve 64. In some embodiments, the air shutter 150' can be fastened on to the valve 64 either at the ledge 68 or otherwise. This can be done, for example, with a friction fit between the slot 80 and the ledge 68. In some embodiments, the nozzle 66 can also be configured to move with the valve. In some embodiments, the valve 64, the nozzle 66 and the air shutter 150' all rotate about the same axis. In some embodiments, the nozzle 66 and the air shutter 150' are coaxial.

The air shutter 150' can also have a slot or hole 82. In some embodiments, the burner delivery line 143' has a corresponding slot or hole 84. The overlap between the holes 82 and 84 can create a window 155' that can allow air to pass into the mixing chamber 157' to mix with the fuel.

The air shutter control 60 can have a user interface surface 70. The user interface surface 70 can be used to control the position of the air shutter 150' and conversely the amount of air that can enter the mixing chamber 157'. The user interface surface 70 can comprise a knob connected to the valve 64. In other embodiments, not shown, the user interface surface 70 can comprise other types of mechanical controls such as a lever, a wheel, a switch, or some other device to transfer a user's movement to move the air shutter 150'. In other embodiments, also not shown, the user interface surface 70 can comprise an electrical or computer control, including but not limited to electrical buttons, electrical switches, a touch screen, etc.

The user interface surface 70 can be rotated from a first position to a second position. The different positions of the user interface surface 70 can result in the window 155' ranging from fully open or substantially fully open to fully closed or substantially fully closed. In some embodiments it can be undesirable to fully close or substantially fully close the window, therefore the position may result in a window that is just short of being fully closed or substantially fully closed.

The air shutter 150' can be set at the factory to an initial position. The factory setting can be a typical setting of the air shutter 70 known to work in many typical situations. The position can be indicated on the user interface surface 70. For example, markings 72 on the user interface surface 70 and an indicator 74 can indicate to a user a position of the air shutter 150'. The indicator 74 can point to a marking 72 to show the position. In some embodiments, the markings 72 can show a relative position of the air shutter 150' between the open and closed positions. In other words, the markings 72 can indicate to a user an increase or decrease in the size of the window 155' and thereby an increase or decrease in the amount of air that can mix with the fuel flow.

If needed, a user, such as an installer, can rotate the user interface surface 70 to change the position of the air shutter 150'. The new position can be indicated on the user interface surface 70. Thus, fine tune adjustment of the air shutter 150' can be provided.

According to some embodiments, the user interface surface 70 can be outside of the sealed combustion chamber 14' and the air shutter 150' can be inside of the sealed combustion chamber 14'. For example, the flange 76 can be used as a fitting to attach the air shutter control 60 to a basket 52 or to a wall of or the floor 50' of the sealed combustion chamber 14'. The injector orifice 66 and the part of the valve attached to the air shutter can be inside the sealed combustion chamber 14' while the rest of the valve, the flange 76 and the user interface surface 70 can be outside of the sealed combustion chamber 14'.

Thus, advantageously the air shutter control 60 can pass into the sealed combustion chamber through the same entry point as the flow of fuel going to the burner 135'. This reduces the number of entry points into the sealed combustion chamber 14 which also reduces the number of fittings or gaskets required to the maintain the seal on the sealed combustion chamber 14.

Figure 4C:
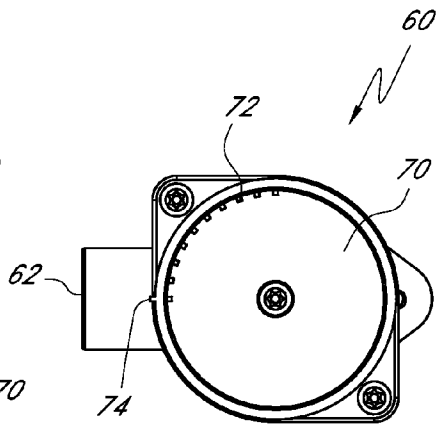
FIGS. 4A-D show front, side, back and top views of an embodiment of an air shutter control.
Figure 4B:
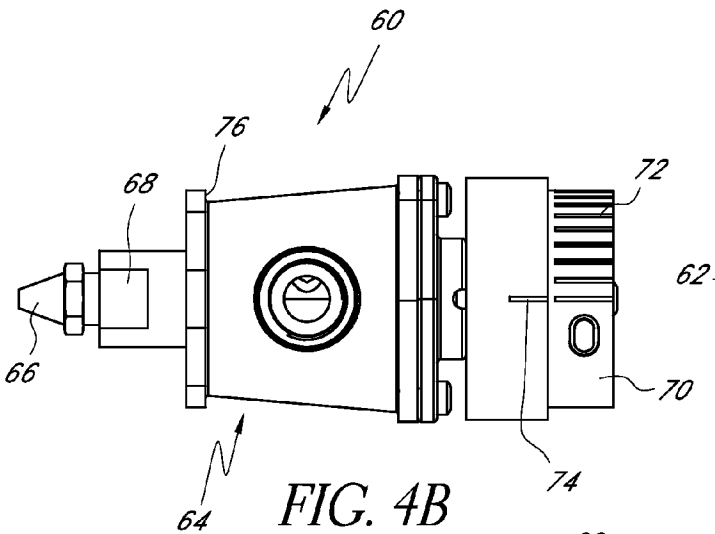
Figure 4D:
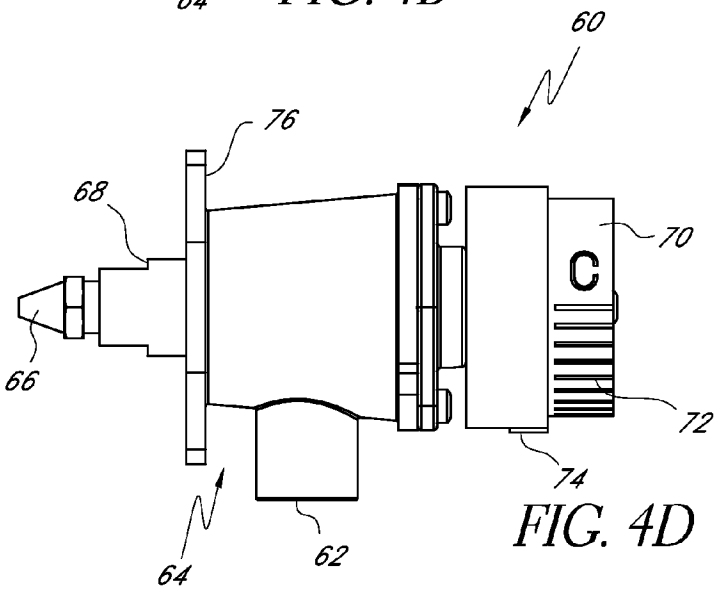
Figure 4A:
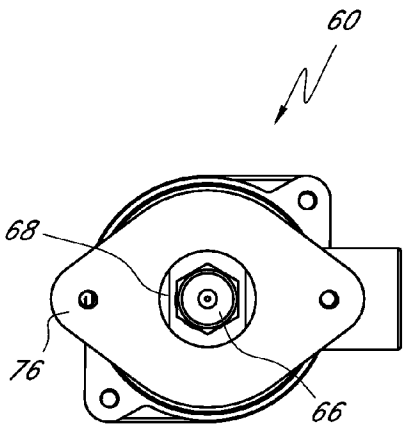
Figure 4E:
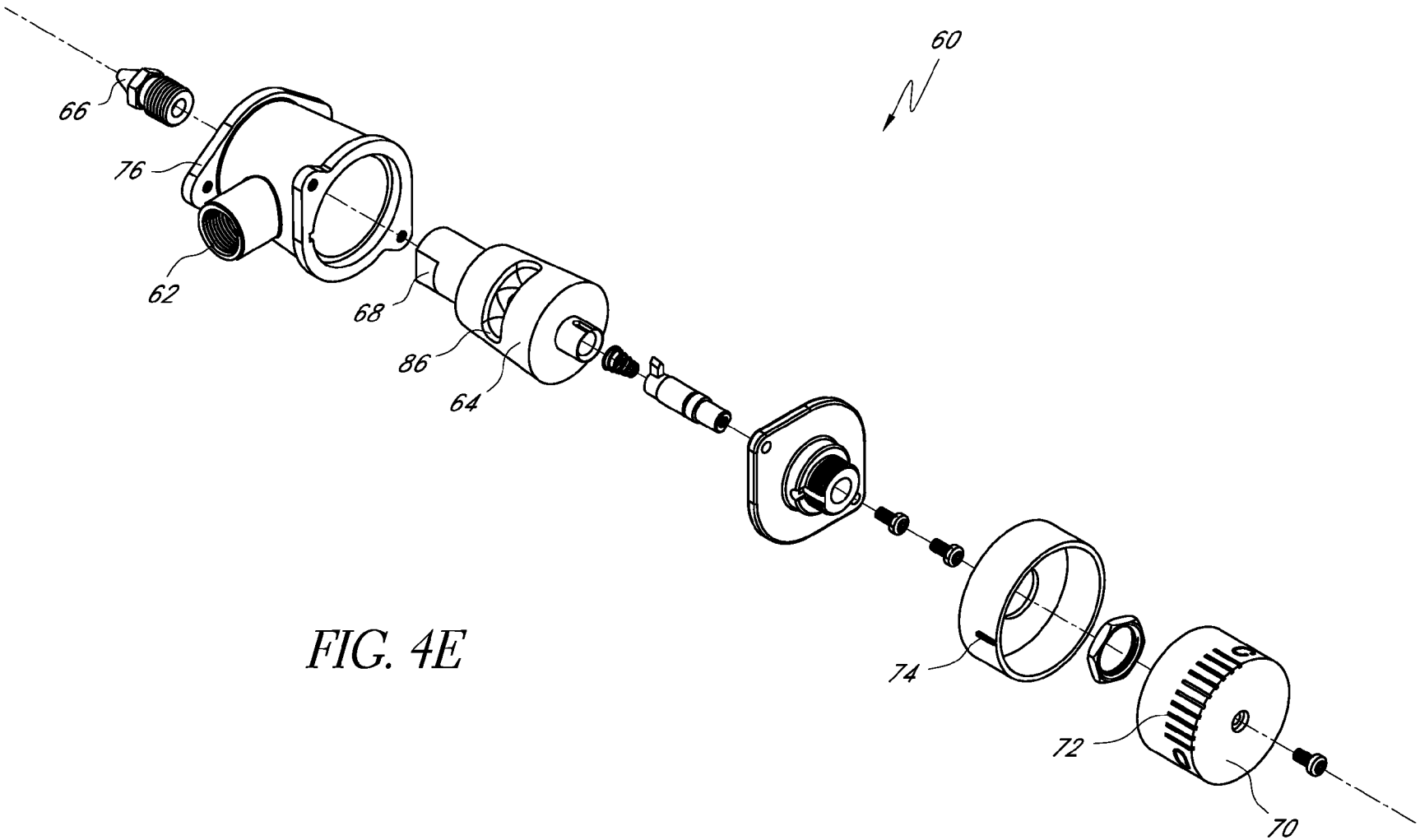
FIG. 4E shows an exploded view of the air shutter control of FIGS. 4A-D.

For the valve 64 to be able to have a large range of motion without affecting the amount of fuel flowing into the valve 64, an enlarged entry port 86 is provided (FIG. 4E). The enlarged entry port 86 is larger than the inlet 62. Thus, fuel can flow into the inlet 62 and then into the enlarged entry port 86 through a full range of movements of the valve 64. The enlarged entry port 86 desirably results in permitting significant flow over a range of motion corresponding to the desired range of motion for the air shutter, for example, at least 15 degrees, 30 degrees, 45 degrees, 60 degrees, 90 degrees and 105 degrees.

The air shutter control 60 can also have a limiting device or mechanism to limit the range of motion of the air shutter and/or the air shutter control. For example, FIG. 5 shows a slot 88 in the air shutter 150' and a peg 78 in the slot 88. The peg 78 can allow the air shutter 150' to rotate until the one side of the slot 88 contacts the peg 78 wherein further movement is prevented.

Reference throughout this specification to "one embodiment" or "an embodiment" means that a particular feature, structure or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures or characteristics of any embodiment described above may be combined in any suitable manner, as would be apparent to one of ordinary skill in the art from this disclosure, in one or more embodiments.

Similarly, it should be appreciated that in the above description of embodiments, various features of the inventions are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A heating apparatus comprising:

a sealed combustion chamber;

a burner within the sealed combustion chamber;

a fuel channel for directing a fuel from a fuel source external the sealed combustion chamber to the burner;

a fitting, through which the fuel channel passes into the sealed combustion chamber;

a burner nozzle communicating with the fuel channel;

an air shutter within the sealed combustion chamber, the air shutter comprising a cylinder having a window and surrounding the fuel channel, the fuel channel having an opening and the air shutter configured to allow or block an amount of air through the opening to alter the amount of air being mixed with the fuel in the fuel channel; and an air shutter control configured to permit the amount of air to be mixed with the fuel through the air shutter to be adjusted, wherein the air shutter control is coupled to the air shutter through the fitting, the air shutter control comprising a valve configured to rotate within the fuel channel and to thereby change the position of the air shutter; and wherein the valve controls a position of the burner nozzle.

2. The heating apparatus of claim 1, wherein the air shutter control is configured to control fine adjustment of the air shutter to adjust the precise amount of air for a particular fuel.

3. The heating apparatus of claim 1, wherein the air shutter control further comprises a user interface surface.

4. The heating apparatus of claim 3, wherein the user interface comprises an adjustment dial.

5. The heating apparatus of claim 1, wherein the valve only having an open fuel flow position.

6. The heating apparatus of claim 1, wherein the valve is configured to rotate the burner nozzle.

7. A heating apparatus comprising:

a combustion chamber;

a burner for combusting a fuel within the sealed combustion chamber;

an air inlet for directing outside air into the sealed combustion chamber;

an exhaust for exhausting waste gas out of the sealed combustion chamber;

an air shutter for allowing air to mix with the fuel to be combusted, the air shutter being within the combustion chamber;

an air shutter control to permit the position of the air shutter to be adjusted and thereby the amount of air to mix with the fuel;

a fuel line partially within the combustion chamber and partially outside of the combustion chamber, configured to direct the fuel to the burner and having an air/fuel mixing chamber; and a burner nozzle communicating with the fuel line and located upstream of the mixing chamber, the burner nozzle configured to inject fuel into the mixing chamber to mix the fuel with air;

wherein the air shutter control is configured to control the air shutter through the fuel line, the air shutter control comprising a valve, the valve being part of the fuel line and the valve controls a position of the burner nozzle.

8. The heating apparatus of claim 7, wherein the valve rotates to rotate the position of the air shutter.

9. The heating apparatus of claim 8, wherein the valve rotates within a fitting such that the fuel line and the air shutter control pass into the combustion chamber together, the combustion chamber being a sealed combustion chamber.

10. The heating apparatus of claim 7, wherein the heating apparatus comprises a direct vent heater.

11. A heating apparatus comprising:

a sealed combustion chamber;

a burner within the sealed combustion chamber;

a fuel channel for directing a fuel from a fuel source external the sealed combustion chamber to the burner;

a fitting, through which the fuel channel passes into the sealed combustion chamber;

a burner nozzle communicating with the fuel channel;

an air shutter within the sealed combustion chamber, the air shutter comprising a cylinder having a window and surrounding the fuel channel, the fuel channel having an opening and the air shutter configured to allow or block an amount of air through the opening to alter the amount of air being mixed with the fuel in the fuel channel; and an air shutter control configured to permit the amount of air to be mixed with the fuel through the air shutter to be adjusted, wherein the air shutter control is coupled to the air shutter through the fitting, the air shutter control comprising a valve configured to rotate within the fuel channel and to thereby change the position of the air shutter; and wherein the valve is configured to rotate the burner nozzle.

12. The heating apparatus of claim 11, wherein the air shutter control is configured to control fine adjustment of the air shutter to adjust the precise amount of air for a particular fuel.

13. The heating apparatus of claim 11, wherein the air shutter control further comprises a user interface surface.

14. The heating apparatus of claim 13, wherein the user interface comprises an adjustment dial.

15. The heating apparatus of claim 11, wherein the valve controls a position of the burner nozzle.

16. The heating apparatus of claim 11, wherein the valve only having an open fuel flow position.

* * * * *